United States Patent [19]

Oswald

[11] 3,991,525

[45] Nov. 16, 1976

[54] APPARATUS FOR SHARPENING BLADES MOUNTED ON DRUMS

[76] Inventor: Fred Oswald, Forest Drive, Sands Point, N.Y. 11050

[22] Filed: July 28, 1975

[21] Appl. No.: 599,824

[52] U.S. Cl. ..... 51/249; 56/250

[51] Int. Cl.[2] ..... B24B 3/55

[58] Field of Search ..... 51/33 R, 33 HK, 47, 51/55, 249, 254; 83/174; 56/250; 241/101.2; 76/82.1

[56] References Cited

UNITED STATES PATENTS

| | | | |
|---|---|---|---|
| 1,789,218 | 1/1931 | Crane | 51/47 |
| 1,834,972 | 12/1931 | Satterstrom | 51/249 X |
| 1,968,609 | 7/1934 | Madsen | 51/249 X |
| 2,245,968 | 6/1941 | Erdman | 51/249 |
| 2,620,606 | 12/1952 | Dvorak | 51/249 |
| 2,849,839 | 9/1958 | Lofquist | 51/55 |
| 3,354,589 | 11/1967 | Postula | 51/249 |
| 3,811,232 | 5/1974 | Reuter | 51/249 |

*Primary Examiner*—Al Lawrence Smith
*Assistant Examiner*—Nicholas P. Godici
*Attorney, Agent, or Firm*—Roberts & Cohen

[57] ABSTRACT

Apparatus for sharpening the operative cutting surface of a blade while the blade is mounted on a drum comprising a mounting unit for attachment to the drum and a linkage pivotably supported on the mounting unit and carrying a rotatable sharpening member in the form of a cup wheel. The linkage is composed of a plurality of link members connected for pivotal movement about axes which are parallel to the pivot axis of the linkage to the mounting unit and parallel to the surface of the blade to be sharpened. The cup wheel is driven in rotation via a flexible shaft and the arrangement of the linkage is such that the sharpening surface of the cup wheel is constrained to lie in planes parallel to the pivot axes while the cup wheel is displaceable along the cutting surface of the blade and constrained to move in a plane perpendicular thereto. An adjusting device can be employed to modify the angular position of the linkage relative to the mounting unit and thereby of the angle of the sharpening surface of the cup wheel so that the grind angle can be adjusted while the mounting unit is secured to the drum.

19 Claims, 3 Drawing Figures

APPARATUS FOR SHARPENING BLADES MOUNTED ON DRUMS

FIELD OF THE INVENTION

The invention relates to apparatus for sharpening blades and particularly to apparatus for sharpening blades while they are mounted in drums.

BACKGROUND AND PRIOR ART

There are numerous circumstances in which blades are mounted on drums and in which it is desired to sharpen the blades after they have been dulled by protracted operation.

As one suitable example, mention can be made of a wood chipping machine in which branches and trunks of trees are reduced to chips by means of cutting blades on a rotating drum. Such chipping machines are relatively large and are powered, for example, by engines of 100 to 200 horsepower. Such machines are conventionally trailer mounted and a plurality of cutting blades, usually four, are mounted in slots in a steel drum approximately twelve inches in diameter and from nine to sixteen inches in width. The drum rotates at a high speed of from 2000 to 3000 R.P.M.

In order to maintain the efficiency of the chipping operation, the blades must be sharpened frequently. Conventionally, this is undertaken by removal of the blades from the drum and sharpening them while they are removed. Thereafter, the blades must be reset into the drum. The total operation requires at least two hours and it takes substantial skill to grind the cutting surface of the blade.

Attempts at hand grinding the blade have proved to be unsatisfactory in practice, since it is virtually impossible to maintain the necessary angle of the cutting surface on the blade.

SUMMARY OF THE INVENTION

An object of the invention is to provide an improved sharpening device which will allow sharpening of the cutting surface of a blade while it remains mounted in a drum.

A further object of the invention is to provide sharpening apparatus which is portable and readily securable on a drum for effecting the sharpening of the blade cutting surface with the blade retained in the drum.

A further object of the invention is to provide apparatus in which the sharpening of the cutting surface of the blade is effected by manually displacing a support of a sharpening member such that the sharpening member will travel along the cutting surface of the blade.

A critical feature of the invention is that the sharpening surface of the sharpening member is constrained to maintain a preset angle corresponding to the angle of the cutting surface with respect to the blade.

In accordance with the above and further objects and features of the invention, there is provided blade sharpening apparatus comprising mounting means for attachment to a support carrying a blade whose cutting surface is to be sharpened, a rotatable sharpening member having a flat sharpening surface adapted for sharpening the cutting surface of the blade, and connection means coupled to the mounting means and supporting the sharpening member for displacement in a plane perpendicular to the plane of the flat sharpening surface and disposed such that the sharpening surface can be brought into contact with the cutting surface of the blade and be advanced thereby.

In further accordance with the invention, the connection means is constructed as a linkage assembly for moving the sharpening member in said plane about a pivot axis perpendicular to said plane.

The linkage assembly is composed of a plurality of link members all of which are pivotably interconnected about axes which extend perpendicular to said plane of movement of the sharpening member.

The invention further contemplates the provision of drive means coupled to the sharpening member for driving the same in rotation about an axis perpendicular to said pivot axis.

The drive means includes a flexible drive element to permit the sharpening member to traverse the cutting surface of the blade, while the sharpening member is driven in rotation.

In further accordance with the invention, the apparatus additionally comprises means for adjusting the linkage means on the mounting means in order to angularly adjust the position of the sharpening surface of the sharpening member while the mounting means remains attached to the blade support. Thereby, the angle of sharpening of the cutting surface of the blade can be adjusted while the apparatus is clamped to the blade support.

Further features of the invention and additional advantages provided thereby will become apparent to those skilled in the art from the following detailed description of an embodiment of the invention. This description will be taken in conjunction with the annexed drawings.

DETAILED DESCRIPTION

Figure 1:
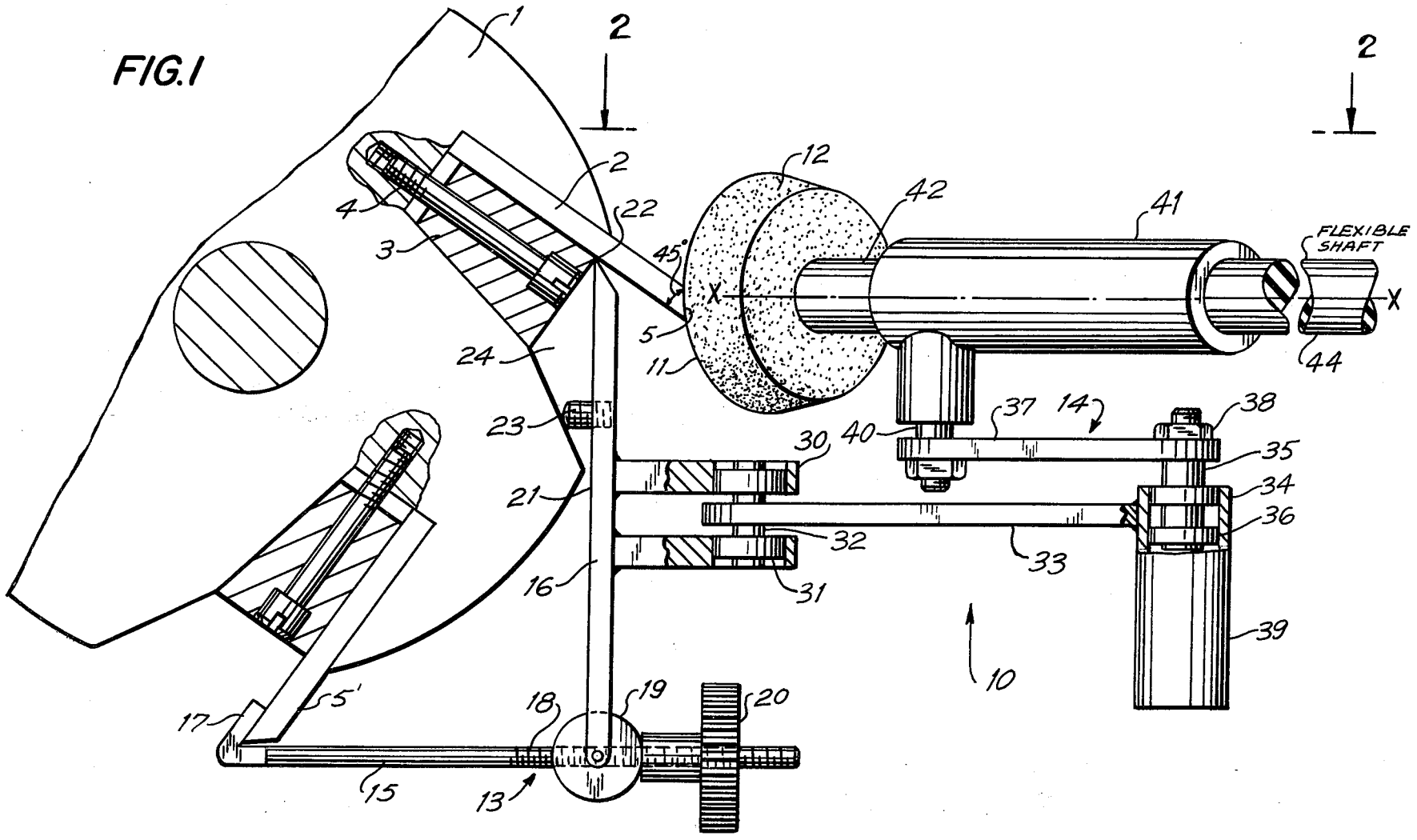
FIG. 1 is a side elevational view of the sharpening apparatus according to the invention shown in operative position to sharpen a blade.

Referring to the drawing, therein is seen a rotatable drum 1 which supports a plurality of cutting members or blades 2. By way of example, the drum and blades can be part of a chipping machine which is intended to reduce tree parts to chips. In general, four blades are mounted in diametric opposition on the drum and two of such blades are illustrated in the drawing to facilitate an understanding of the manner in which the apparatus of the invention is intended to be employed.

The blades 2 are mounted in corresponding slots in the drum 1 and are secured in position therein by means of wedges 3 which in turn are secured in the drum by lock bolts 4. An adjustment means is conventionally provided to regulate the degree of projection of the blades from the surface of the drum but such means is not shown herein as this is not essential to the invention and is not required for an understanding thereof.

In the course of operation of the chipping machine, the cutting surfaces 5 of the blades become dull and it is necessary to sharpen the blades in order that they satisfactorily carry out the chipping operation. For this purpose, the invention contemplates the provision of a portable sharpening apparatus generally indicated at 10 which is capable of being secured to the drum 1 in a fixed position for sharpening the cutting surface 5 of the blades.

The cutting surface 5 of the blade generally lies in a plane at an angle of 45° with respect to the longitudinal axis of the blade. It is essential that the apparatus of the invention when mounted on the drum exactly follow this cutting surface to effect sharpening thereof. An essential requirement and characterizing feature of the sharpening apparatus is that once it has been mounted on the drum and secured in place the edge 11 of the sharpening surface of a grinding or sharpening member 12 of the apparatus will maintain a fixed grinding angle with respect to the cutting surface 5 of the blade as will be explained in greater detail later.

The sharpening apparatus of the invention essentially comprises a mounting means 13 for attachment to the drum 1, a linkage means 14 supported on the mounting means and in turn carrying the grinding or sharpening member 12, so that the sharpening surface thereof can be brought into operative contact with the cutting surface 5 of the blade.

The mounting means 13 comprises a rod 15 and a base plate 16 which enables the sharpening apparatus to be mounted on the drum. The rod 15 has a hook 17 at one end which is adapted to engage the blade adjacent the one whose cutting surface is to be sharpened. As shown in FIG. 1, this blade is designated by 5'. At the end of rod 15 opposite hook 17, a threaded portion 18 is threadably engaged in a cylinder 19 and extends beyond the cylinder to threadably receive a locking knob 20. In operation, after the hook has been engaged on the blade 5' and the mounting means secured on the drum in a manner to be explained later, the knob 20 is advanced on threaded portion 18 of rod 15 so as to bear against cylinder 19 and lock the mounting means on the drum.

The base plate 16 is fixedly secured to the ends of cylinder 19 and has an upper edge 22 of pointed shape which is adapted to bear against the wedge 3 which holds the blade 2 in the drum. The base plate 16 carries two adjusting screws 23 (only one being visible in FIG. 1), extending from the rear face 21 of the base plate, and the screws 23 are intended to bear against the drum 1. The drum is provided with reference marks for engagement of the pointed edge 22 and the adjusting screws 23. By adjusting screws 23, exact correspondence can be made between the contact points of the screws and the pointed edge 22 with the reference marks on the drum.

It is to be noted that the drum 1 is provided with a recess 24 at which the wedge and blade is mounted within the drum. It is in this recess that the adjusting screws 23 engage the drum in order for the entire assembly to be tightly clamped on the drum 1.

The linkage means 14 is secured to the base plate 16 by means of a clevice 30 which receives a sealed bearing 31 and a pivot shaft 32. A first link member 33 is pivotably mounted on pivot shaft 32 and is secured to a clevice 34 at the end remote from shaft 32. Clevice 34 supports a pivot shaft 35 in sealed bearings 36 and a second link member 37 is pivotably mounted on shaft 35. A lock nut 38 serves to hold the pivot shaft 35 in place, and a handle 39 extends downwardly from link member 33 and is secured thereto.

The link member 37 carries a pivot shaft 40 at the end remote from pivot shaft 35 and a hand piece 41 is mounted on the pivot shaft 40 for pivotal movement.

The hand piece 41 rotatably carries a device shaft 42 at the end of which is affixed the sharpening member 12. The sharpening member is in the form of a cup wheel with an annular sharpening surface 43. A flexible shaft 44 is connected to the drive shaft 42 and in turn is driven by a motor (not shown) so that the cup wheel can be driven in rotation about the axis of shaft 42.

In order for the plane passing through the sharpening surface 43 of the cup wheel 12 always to make contact with the blade 2 in the planar relation with the cutting edge 5 thereof, it is essential that the linkage constrain the wheel to move in a plane perpendicular to the cutting edge 5 of the blade. In order to achieve this, it is necessary that the axes passing through pivot shafts 32, 35 and 40 are all parallel to one another and parallel to the cutting edge 5 of the blade. In this way, the rotational axis of the cup wheel designated by XX in FIG. 1 will be constrained to travel in a plane perpendicular to the cutting edge 5 of blade 2.

In operation, it is only necessary for a workman to hold hand piece 41 and move the cup wheel along the cutting edge 5 of blade 2 in order to effect sharpening of the blade edge. It is not necessary for the workman to exercise any skilled hand operation as the cup wheeel will automatically be positioned to grind the surface of the cutting edge of blade 2. Usually, the drum is locked in rotation during the grinding of the cutting surface of the blade, however, even if the drum should slip or rotate slightly, the cup wheel still remains in its fixed geometrical relation with the blade.

Figure 2:
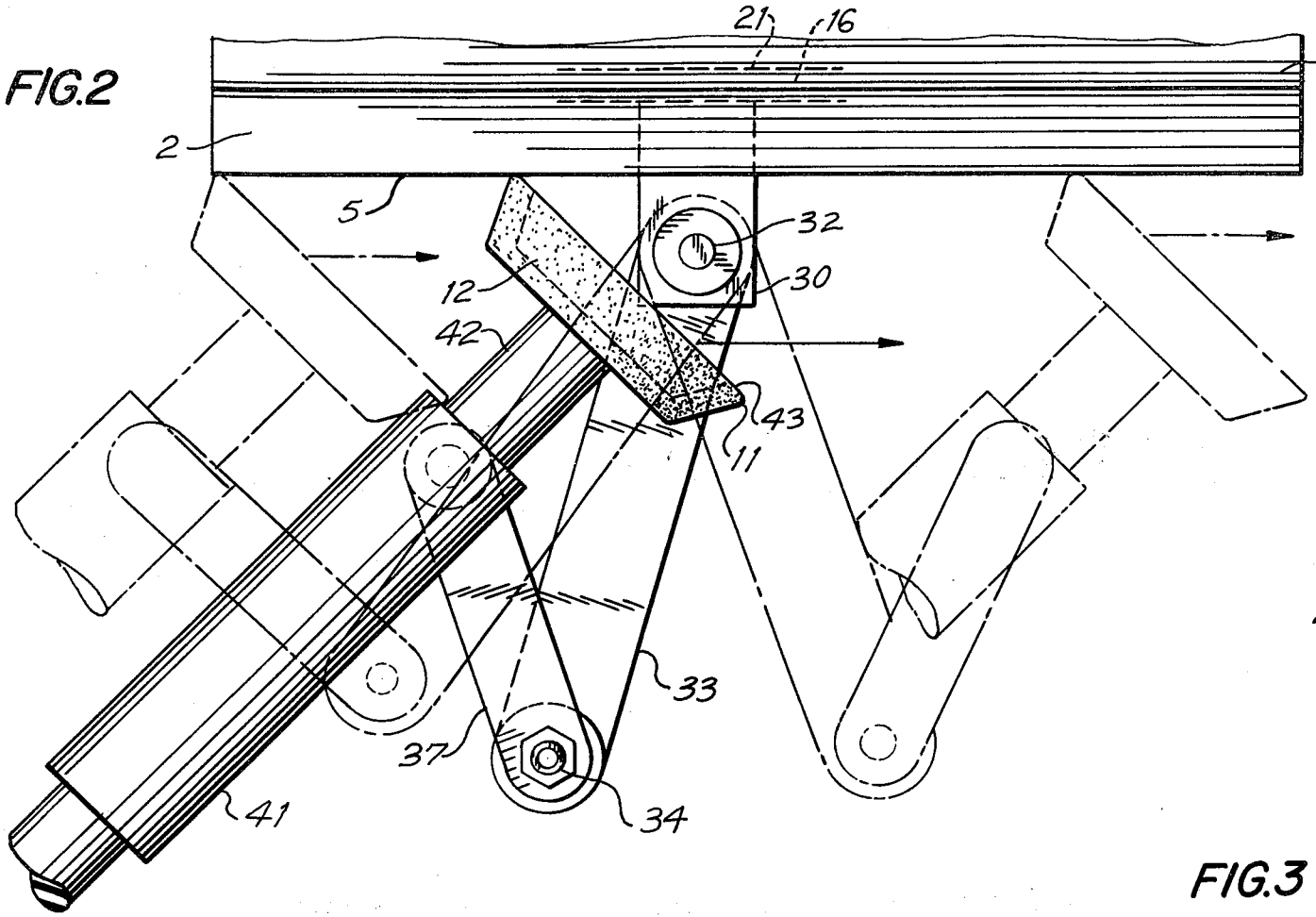
FIG. 2 is a top plan view thereof, showing the cutting blade in one cutting position in solid lines and in a second cutting position in chain dotted lines.

As can be seen from FIG. 2, the cup wheel can be displaced along the blades in a fixed angular orientation to effect sharpening of the cutting surface. The particular angular relation which the cup wheel makes in plan view relative to the cutting surface of the blade will determine the degree of hollow grinding of the cutting surface 5. Namely, as shown in FIG. 2, the left edge of the cup wheel contacts the grinding surface and will form a hollow grind in said surface. By increasing the angle between link members 33 and 37, it becomes possible to increase the degree of hollow grindng. Alternatively, by diminishing the angle between the two link members, the degree of hollow grinding can be reduced and even eliminated. In the latter case, the axis will be perpendicular to the edge of blade 2. In general, the cup wheel will be held in a fixed angular position with respect to the edge of the blade as it traverses the length of the blade as seen in FIG. 2.

Figure 3:
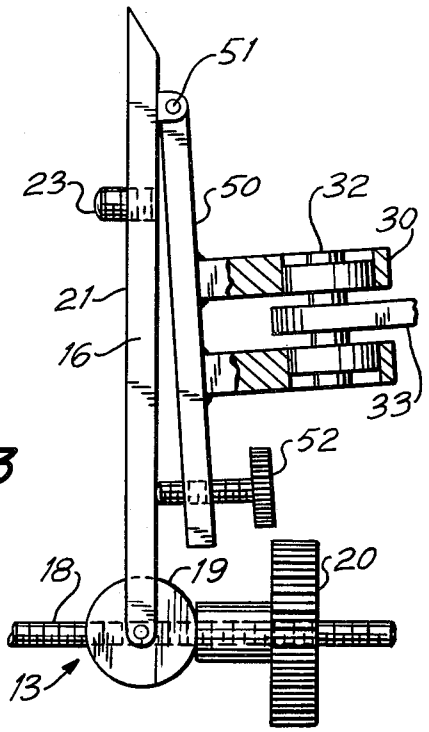
FIG. 3 shows a modified arrangement of a portion of the apparatus of FIG. 1.

Referring to FIG. 3, herein is shown a modification which enables adjustment of the grinding angle while the mounting means is fixed to the drum. All elements of the construction which are similar to FIG. 1 are given the same numerals and will not be described further.

Referring to FIG. 3, it is seen that a second base plate 50 is pivotably connected by pivot 51 to the base plate 16 and the clevice 30 is fixed to the second plate 50. An adjusting screw 52 is rotatably mounted in base plate 16 and restrained against axial movement and the second base plate 50 is threaded on adjusting screw 52 such that by rotating the adjusting screw, the base plate 50 can be made to pivot about pin 51 with respect to base plate 16. Thereby, the angular position of the pivot shafts 32, 35 and 40 can be adjusted relative to base plate 16 in order to bring the plane of the sharpening surface 43 of the cup wheel into exact correspondence with the angle of the operative cutting surface of blade 2.

Although the invention has been described in relation to a specific embodiment thereof, numerous modifications and variations will become apparent to those skilled in the art without departing from the scope and spirit of the invention. Thus, instead of a linkage assembly as shown, it may be also possible to employ a slide which is mounted on the base plate 16 and which constrains the cup wheel to move in a plane parallel to the cutting surface 5 of the blade 2. It is to be noted, however, that the linkage arrangement is preferred over the sliding device, since the bearings can be easily sealed against grinding debris.

What is claimed is:

1. Apparatus for sharpening a blade mounted on a support, the blade having an operative cutting surface, said apparatus comprising mounting means for attachment to said support, a rotatable sharpening member having a sharpening surface with at least one edge lying in a plane and adapted for sharpening the cutting surface of the blade, and connection means coupled to the mounting means and supporting the sharpening member for movement in a plane perpendicualr to the plane of the edge of the sharpening surface and disposed such that the sharpening surface can be brought into contact with the cutting surface of the blade and be advanced therealong, said connection means being a linkage means for moving said sharpening member in said plane about a pivot axis perpendicular to said plane of movement.

2. Apparatus as claimed in claim 1 wherein the sharpening surface of the sharpening member is circular.

3. Apparatus as claimed in claim 1 comprising drive means coupled to the sharpening member for driving the same in rotation about an axis perpendicular to said pivot axis.

4. Apparatus as claimed in claim 3 wherein said drive means includes a flexible drive element operatively coupled to the sharpening member to permit pivotal movement thereof about said pivot axis while driving the sharpening member in rotation.

5. Apparatus as claimed in claim 1 wherein said mounting means includes adjustment means for bringing the sharpening surface of the sharpening member into operative position for sharpening the cutting surface of the blade.

6. Apparatus as claimed in claim 5 wherein said adjustment means includes adjustment members for displacing the linkage means to adjust the position of said pivot axis.

7. Apparatus as claimed in claim 1 comprising a manually engageable handle coupled to the linkage means for pivotably moving the sharpening member about said pivot axis in the course of advancing the sharpening surface along the cutting surface of the blade during blade sharpening.

8. Apparatus as claimed in claim 1 wherein said mounting means has three points of support, said apparatus further including means for adjusting the linkage means relative to said three points to bring the sharpening surface into operative position for sharpening the cutting surface of the blade.

9. Apparatus as claimed in claim 1 wherein the cutting surface of the blade defines an inclined face disposed at an operative cutting angle, said sharpening member being a cup wheel for hollow grinding said cutting surface thereof.

10. Apparatus as claimed in claim 1 wherein said mounting means comprises a rod with a hooked end, and a base plate supported on said rod and having two support points remote from said rod.

11. Apparatus as claimed in claim 10 wherein said rod is threaded in said base plate.

12. Apparatus as claimed in claim 10 wherein said linkage means is mounted on said base plate.

13. Apparatus as claimed in claim 10 comprising means for adjusting the position of one of said support points relative to said hook means.

14. Apparatus as claimed in claim 1 wherein the support for the blade comprises a rotatable drum, a plurality of said blades being mounted on said drum and projecting radially therefrom, said mounting means including hook means for engaging one of the blades other than the blade being sharpened and two support points for contacting the drum to hold the mounting means thereon.

15. Apparatus as claimed in claim 14 wherein said drum has reference marks for receiving said support points of the mounting means.

16. Apparatus as claimed in claim 9 wherein said face of the blade is inclined at 45°.

17. Apparatus as claimed in claim 1 wherein said linkage means includes a plurality of pivotal connections having pivot axes parallel to the pivot axis of the sharpening member.

18. Apparatus as claimed in claim 1 comprising means adjustably supporting said linkage means on said mounting means for angularly adjusting the positioning of the sharpening surface of said sharpening member while the mounting means remains attached to the blade support.

19. Apparatus as claimed in claim 18 wherein the adjustable supporting means for the linkage means on the mounting means includes a pivotal connection.

* * * * *